United States Patent [19]

Morphy

[11] 4,040,166

[45] Aug. 9, 1977

[54] METHOD OF CONSTRUCTION OF INSULATED CABINET

[75] Inventor: Paul H. Morphy, Prairie Village, Kans.

[73] Assignee: Hobart Corporation, Troy, Ohio

[21] Appl. No.: 711,442

[22] Filed: Aug. 4, 1976

[51] Int. Cl.[2] ..... B23P 3/00; B23P/19/04;

[52] U.S. Cl. ..... 29/460; 220/9 G; 264/261

[58] Field of Search ..... 29/455, 460, 445; 220/9 G X; 264/261, 262

[56] References Cited

U.S. PATENT DOCUMENTS

| | | | |
|---|---|---|---|
| 1,576,955 | 3/1926 | Dubraks | 220/9 G |
| 2,604,426 | 7/1952 | Beekman | 264/261 X |
| 2,628,416 | 2/1953 | Sampson | 264/262 X |
| 3,137,744 | 6/1964 | Burrus | 220/9 G X |
| 3,221,085 | 11/1965 | Rill, Jr. et al. | 29/460 UX |
| 3,802,975 | 4/1974 | Saidla | 264/261 X |
| 3,811,173 | 5/1974 | Baumann | 29/460 |
| 3,827,135 | 8/1974 | Yamamoto | 29/460 X |
| 3,882,591 | 5/1975 | Yamamoto | 29/460 X |

*Primary Examiner*—Charlie T. Moon
*Attorney, Agent, or Firm*—Biebel, French & Nauman

[57] ABSTRACT

An improved insulated cabinet, such as a refrigerator or freezer cabinet, is constructed by first manufacturing a rigid structural frame to close tolerances and then loosely attaching the remaining components of the outer shell of the cabinet by mechanical connections which permit some relative movement between the main frame and the other outer shell components. The outer shell, with an inner shell positioned within it in spaced relationship to define an insulating cavity, is then placed in a jig which positions precisely the components of the outer shell in their desired final relationship. The loose connections between the outer shell components permit them to be shifted by the contacting surfaces of the jig into the precise relative positions desired, and while the outer shell components are so supported by the jig, a hardenable insulating material is introduced into the cavity, where, upon hardening, it fixes the outer shell components and the inner shell in their desired positions relative to each other. Any convenient form of mechanically interconnecting the outer shell components which permits relative movement can be utilized, such as deforming or crimping contacting surfaces, utilizing self-tapping screws and combinations of these connections.

8 Claims, 15 Drawing Figures

METHOD OF CONSTRUCTION OF INSULATED CABINET

BACKGROUND OF THE INVENTION

In conventional insulated cabinet constructions the various components making up the cabinet are rigidly attached to each other, usually by continuous welds along their contacting surfaces. To insure that the components are positioned properly with respect to each other a great deal of care must be taken during the welding process, usually requiring that the parts be positioned by jigs at each welding step to insure any deviation of the components from their desired positions relative to each other falls within fairly close tolerances. Obviously this is a very time cnsuming process and appreciably increases the cost of the resulting cabinet.

More recently, cabinet constructions have been proposed wherein precision welding of all of the components is eliminated and the hardenable insulating material generally associated with cabinets of this type relied upon, not only for its insulating properties, but to structurally interconnect the cabinet components. Assemblies of this type are shown in French Pat. No. 1,362,178, allowed Apr. 20, 1964 and published in French Official Gazette No. 22 of 1964; and U.S. Pat. No. 3,948,407 and 3,948,410.

In the above noted French patent the desired positional relationships between the components of the cabinet are apparently attained in some manner by use of an appropriate supporting mold. In the two U.S. patents the outer shell of the cabinet of each is formed of a one-piece wrap around construction which is held on a base, an inner liner inserted in the outer shell and insulating material foamed between the outer shell and the inner liner.

Thus, in more recent prior art cabinet constructions a supporting mold of some type which is capable of holding each of the various cabinet components in position while insulating material is foamed between then must be utilized, or a sheet of steel or the like of rather substantial size must first be formed into a one-piece, wrap around type outer shell.

SUMMARY OF THE INVENTION

In accordance with the present invention an insulated cabinet is provided which does not rely upon the use of a support or fixture of some type to hold the cabinet components together nor must a single large sheet of steel or other material be utilized to form, in effect, an integral, wrap around type outer shell.

Instead, a main structural frame is first constructed to rather precise dimensional tolerances and with the main frame serving as the basic component of the cabinet outer shell, additional outer shell components are loosely attached to each other and the main frame to form an outer shell in which the components are only approximately positioned with respect to their desired final positional relationship and capable of limited movement with respect to each other.

Thereafter, the loose assembly of components, with an inner shell positioned within, it is placed in a jig which squares up the outer shell by shifting the loosely connected components thereof into their desired final positions and, while the outer shell components and the inner shell are held in this manner by the jig, a hardenable insulating material is introduced into the insulating cavity defined by the inner and outer shells and fixes the formerly loosely fitted outer components in position with respect to each other and the inner shell.

Thus, it is unnecessary to reply upon some sort of supporting mold to hold each of the cabinet components in position for foaming nor is it necessary to form a large, substantially one-piece wrap around shell to eliminate the prior art disadvantage of precision welding each of the cabinet components together.

DESCRIPTION OF THE PREFERRED EMBODIMENTS

Figure 1:
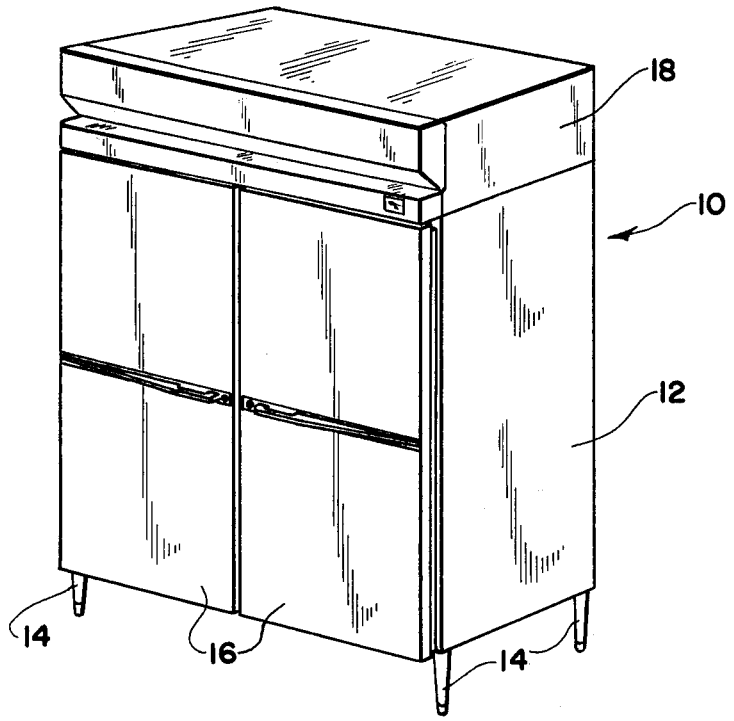
FIG. 1 is a perspective view of a refrigerator cabinet constructed in accordance with the present invention.

An insulated cabinet, such as a freezer or refrigerator cabinet, is shown at 10 in FIG. 1 of the drawings. The cabinet includes an enclosure 12 supported by legs 14 and provided with doors 16, while an upper trim section 18 conceals various mechanical components usually associated with cabinets of this type. While a particular type of cabinet structure is shown for purposes of illustration in FIG. 1 and is described below, it will be apparent that the principles of the present invention are capable of general application to a variety of structures of this general type.

With reference to FIGS. 4 through 7 of the drawings it will be seen that the base cabinet structure includes an inner shell 20, preferably formed of steel or molded plastic, and an outer shell 22, preferably formed of steel, which together define an insulating cavity 23 between their opposing surfaces. The inner shell 20 may be formed in any convenient manner and the particular method of construction does not per se form part of the present invention.

Figure 2:
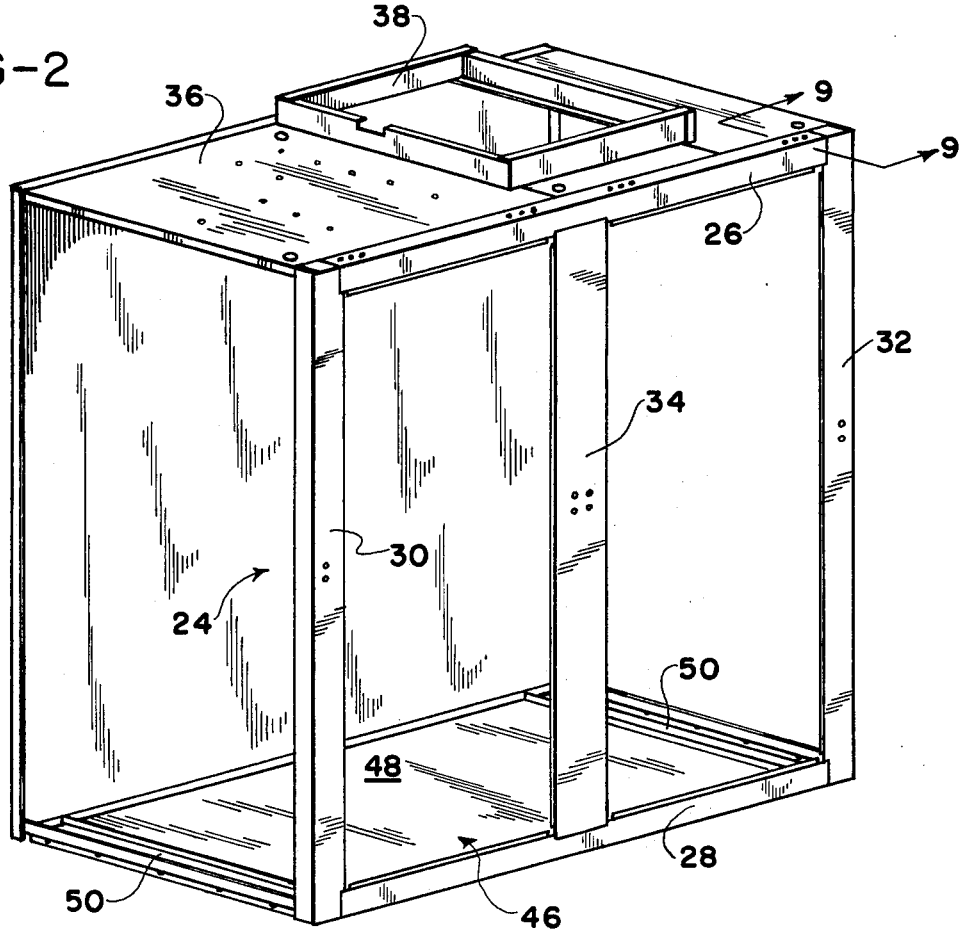
FIG. 2 is a perspective view of a partially assembled outer shell of the cabinet of FIG. 1.

With continued reference to FIGS. 4 through 7 and additionally FIG. 2, it will be seen that a basic component of the outer shell 22 is a precisely manufactured structural frame 24. Frame 24 includes upper and lower horizontally extending rails 26 and 28, respectively, vertically extending stiles 30 and 32 and a central mullion 34. As noted above, while a particular size and shape cabinet has been selected for purposes of illustration it will be apparent that both the size and shape can be varied within the scope of the present invention and the particular configuration of the main structural frame 24 can be varied accordingly.

The components 26, 28, 30, 32 and 34 are constructed to close tolerances and joined at their contacting surfaces by continuous welds while the components are held in precise relationship to each other by a welding fixture. Thereafter the welded joints are ground to provide a flush outer surface and the entire main structural frame 24 polished to provide, in effect, an integral, rigid structural frame precisely manufactured within close dimensional tolerances.

Following construction of the main structural frame 24 additional components of the outer shell 22 are loosely attached to it and to each other by mechanical connections which permit limited relative movement between the various components.

For example, a shell top assembly 36 including a collar assembly 38 has the components thereof interconnected by crimping using a standard crimping tool and the shell top assembly and the upper rail 26 are also interconnected by a series of crimps formed along their contacting surfaces.

Figure 9:
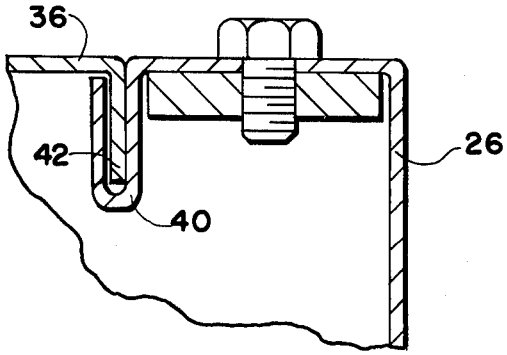
FIG. 9 is a cross-sectional view taken along line 9—9 of FIG. 2.

As seen in FIG. 9, the rail 26 is provided with a channel into which a flange of the shell top assembly 36 is inserted to form a connection 42 and a series of dimple-like depressions is formed through the three thicknesses of metal by a standard crimping tool at a series of spaced points along the contacting portions of the rail and shell top to provide loose mechanical connections which permit limited relative movement. A typical crimp type connection is shown in cross section at 44 in FIG. 11 of the drawings.

Figure 5:
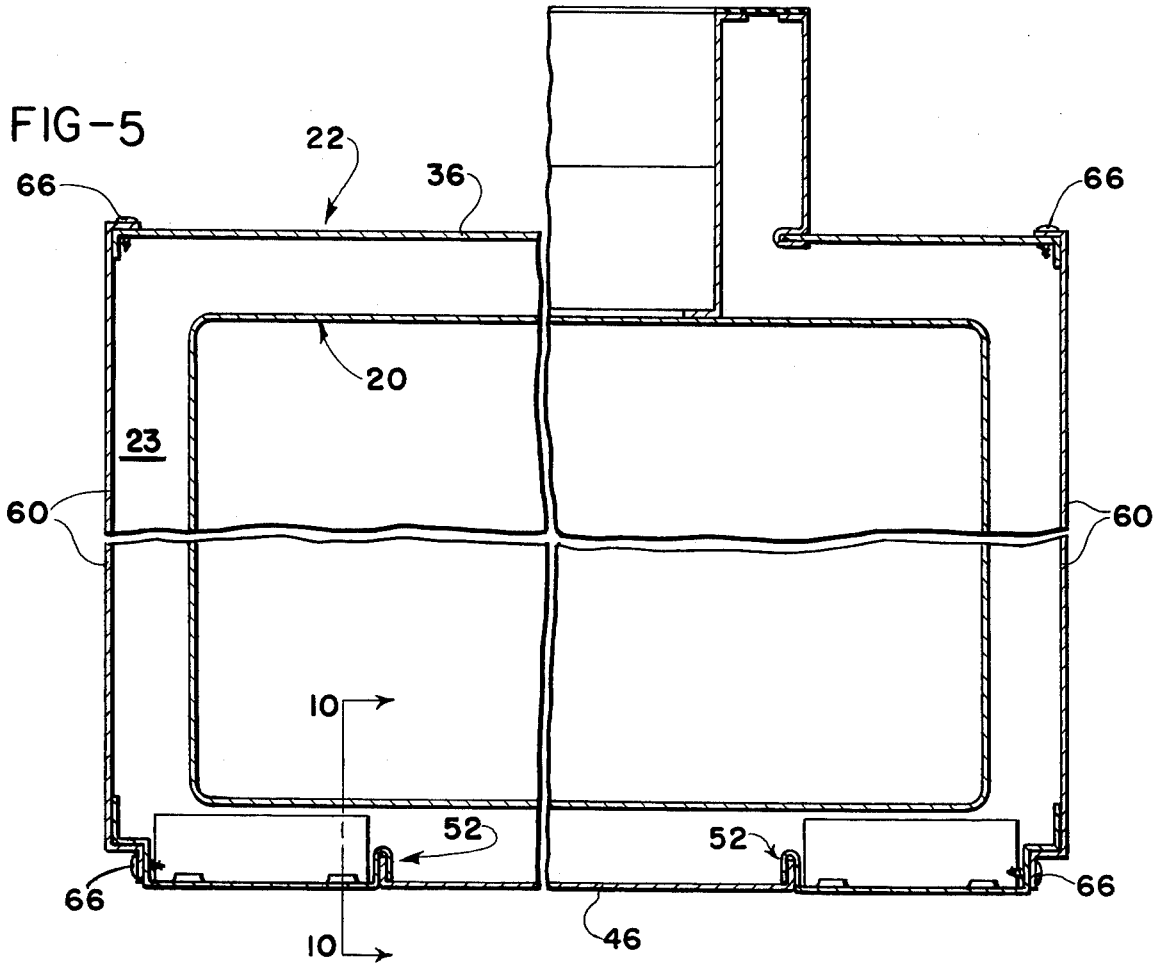
FIG. 5 is a cross-sectional view taken along line 5—5 of FIG. 4.

A bottom shell assembly 46 consisting of a central panel 48 and end channels 50 is formed with members 48 and 50 having interfitting portions 52 similar to the portion 42 of the top rail and shell top assembly as best seen in FIGS. 2 and 5 of the drawings. The interfitting portions 52 are then secured with crimp type mechanical connections similar to those shown in FIG. 11 of the drawings again, permitting some relative movement between the components of the bottom shell assembly.

Figure 7:
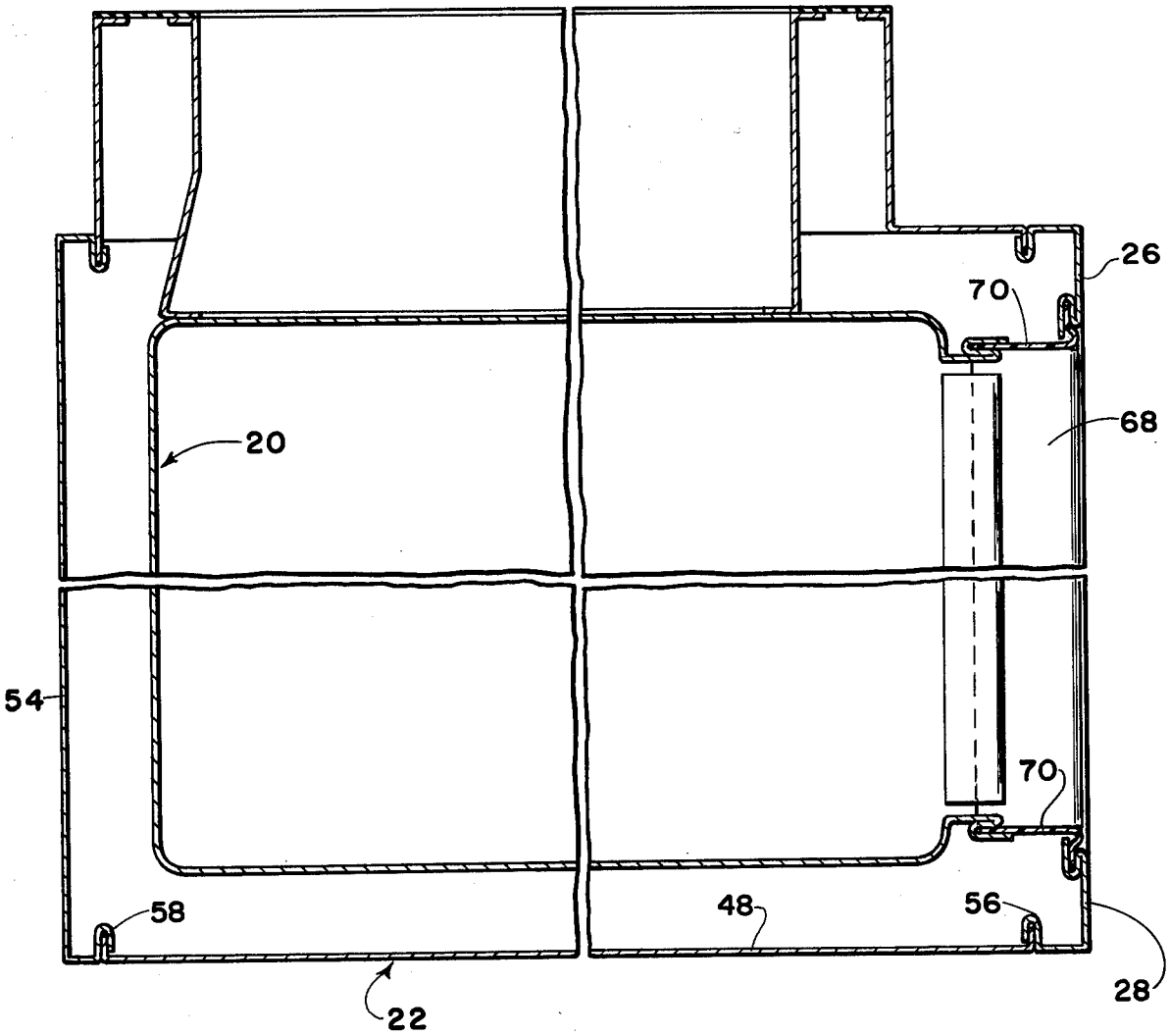
FIG. 7 is a vertical cross-sectional view taken along line 7—7 of FIG. 4.
Figure 11:
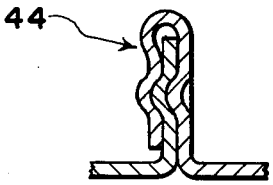
FIG. 11 is a cross-sectional view showing a typical crimp type connection.
Figure 10:
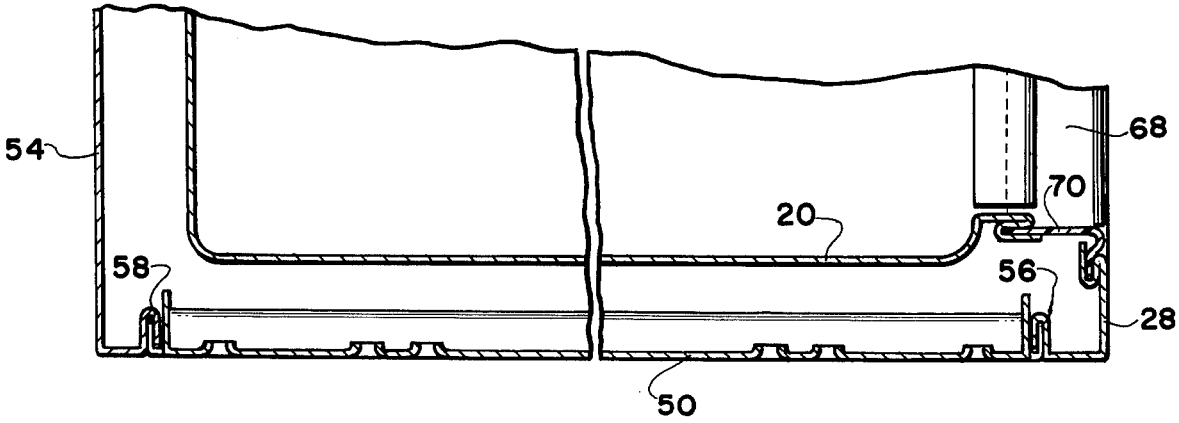
FIG. 10 is a cross-sectional view through a bottom portion of the cabinet taken along line 10—10 of FIG. 5.
Figure 12:
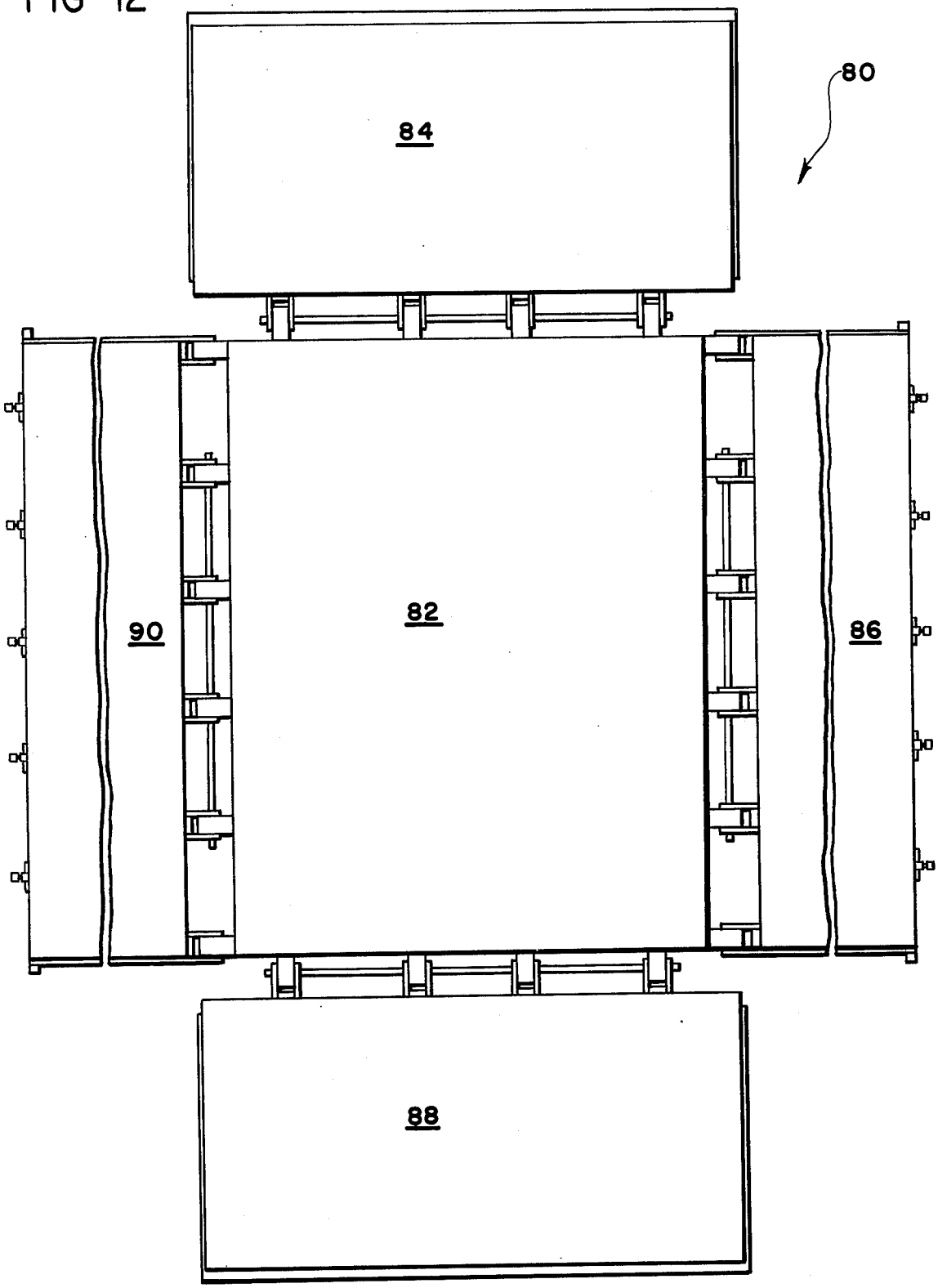
FIG. 12 is a plan view of an open jig used in the method of the present invention.

The bottom shell is then connected to the lower horizontal rail 28 and a back panel 54, as seen in FIGS. 7 and 10 of the drawings, by interfitting portions 56 and 58, respectively, which are then crimped in the manner shown in FIG. 11 of the drawings. At this point the partially completed outer shell is as shown in FIG. 2 of the drawings, with only the main structural frame 24 of rigid construction and the remaining components loosely attached thereto and capable of limited relative movement.

Figure 3:
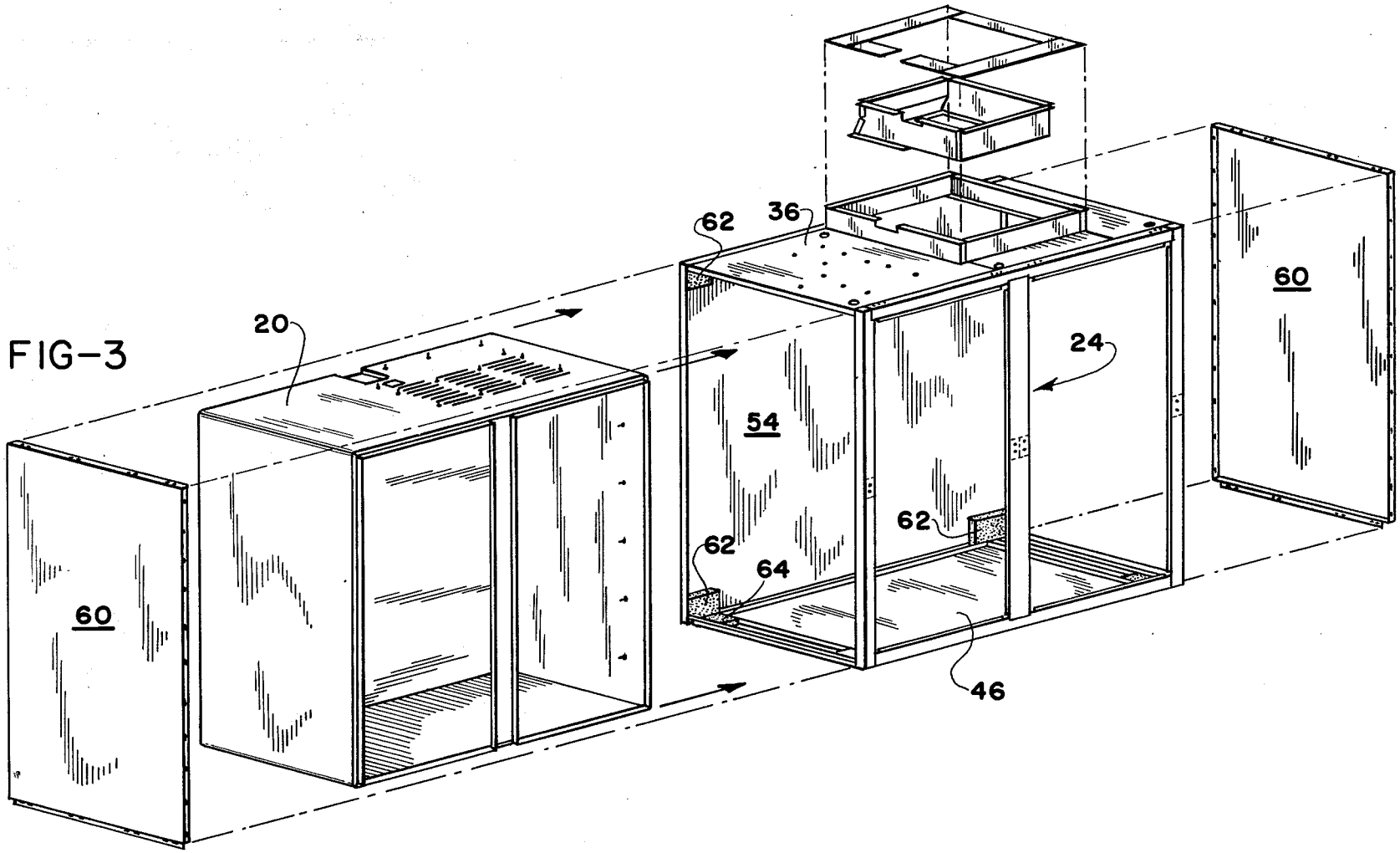
FIG. 3 is an exploded perspective view of the cabinet components.

Thereafter, and as seen in FIG. 3 of the drawings, the inner shell 20 may be inserted in the partially completed outer shell, preferably, although not necessarily, after one of the end panels 60 is attached to the partially completed shell, with the inner shell 20 positioned in spaced relationship to opposing surfaces of the outer shell by means of spacer blocks 62 and 64 of foamed insulating material or the like.

Figure 6:
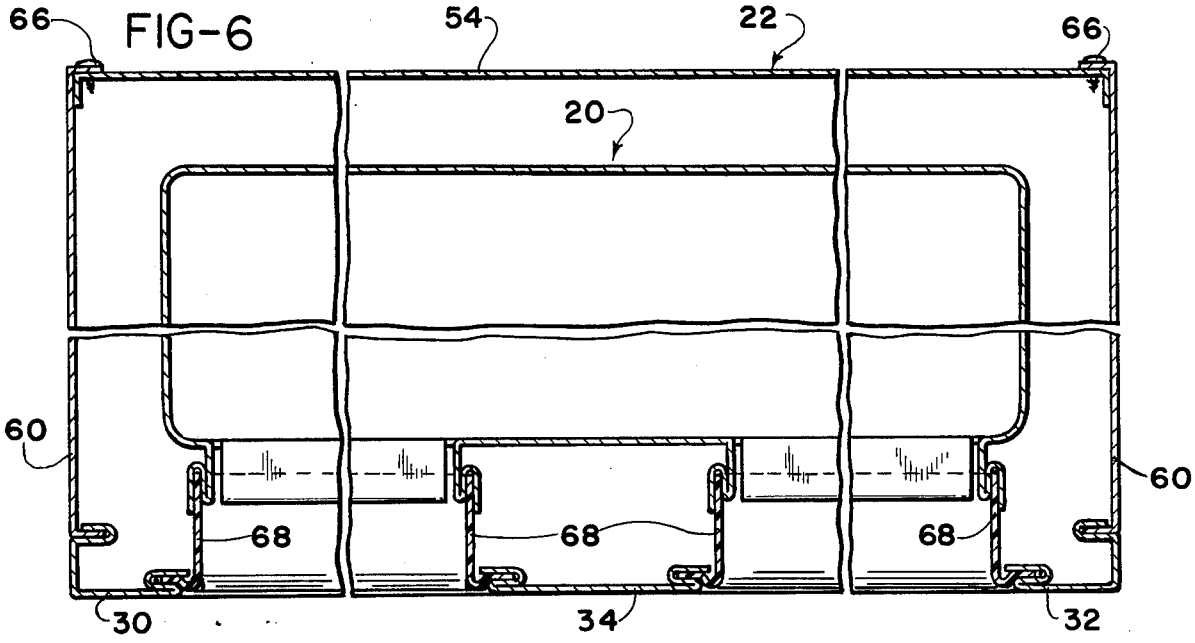
FIG. 6 is a horizontal cross-sectional view taken along line 6—6 of FIG. 4.

The other end panel 60 can then be attached to the top and bottom shell assemblies 36 and 46, respectively by means of self-tapping screws 66 as seen in FIG. 5 of the drawings, and to the back panel 54 in a similar manner as shown in FIG. 6 of the drawings. Crimped, interfitting connections, similar to those shown in FIG. 11 of the drawings, can be formed between the forward vertical edges of the panels 60 and the stiles 30 and 32 as seen in FIG. 6 of the drawings.

Figure 4:
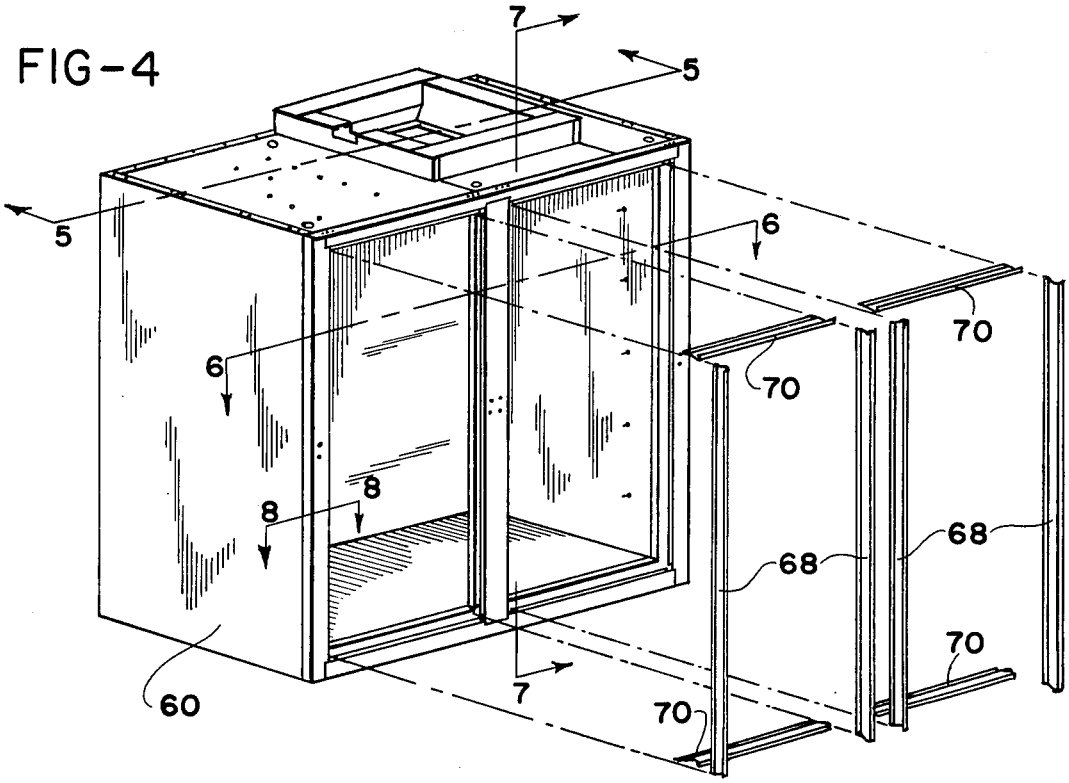
FIG. 4 is an exploded perspective view of a partially assembled cabinet.
Figure 8:
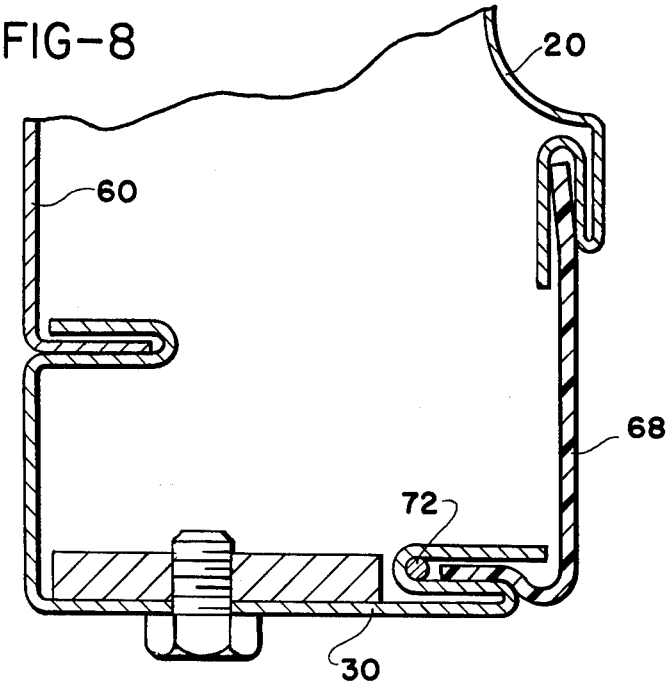
FIG. 8 is a horizontal cross-sectional view through a front corner of the cabinet taken along line 8—8 of FIG. 4.

At this stage in the construction of the cabinet of the present invention the entire housing has been assembled as seen in FIG. 4 of the drawings, but the components of the outer shell are merely loosely interconnected and capable of relative movement between each other. At this point vertical and horizontal breaker strips 68 and 70, respectively, are positioned in grooves formed in the components of the main structural frame and the inner shell 20, as seen in FIGS. 6, 7, 8 and 10 of the drawings. Prior to inserting the breaker strips a heating coil 72 is inserted in the groove formed in the structural members, as seen in FIG. 8 of the drawings.

Figure 13:
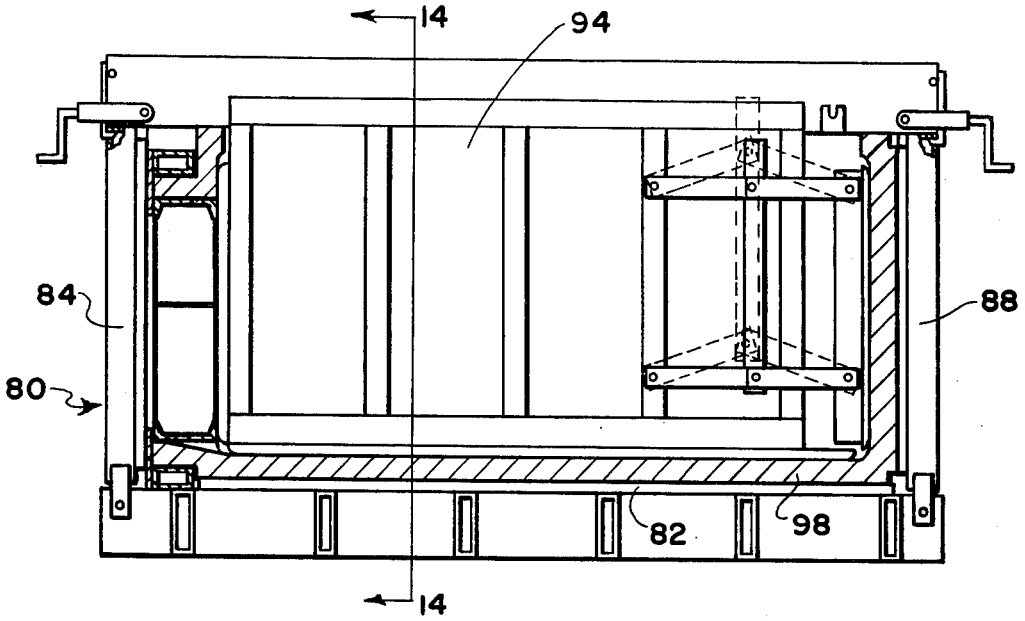
FIG. 13 is a cross-sectional view through the jig in its closed position showing somewhat schematically a cabinet supported therein.
Figure 14:
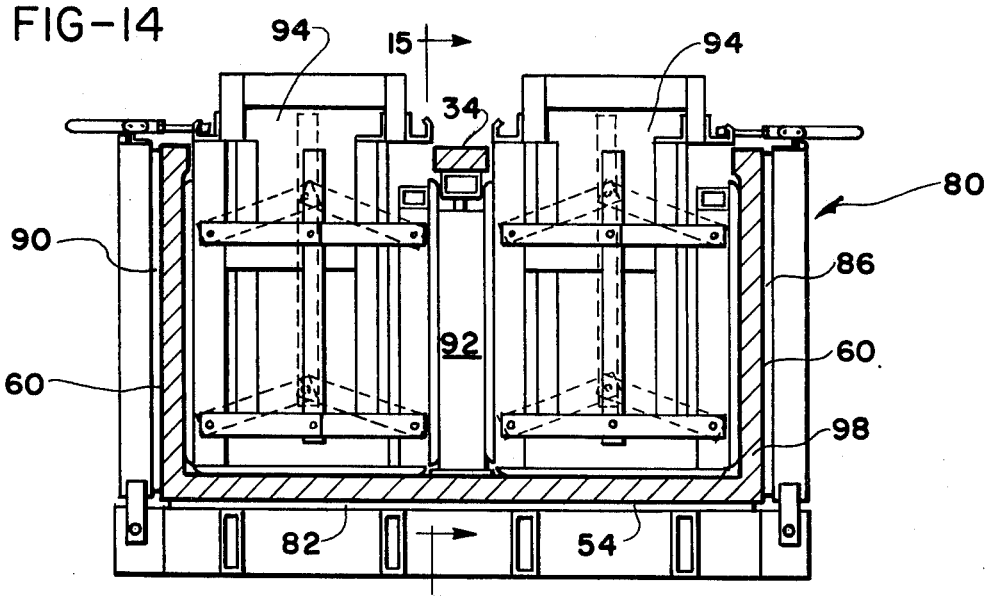
FIG. 14 is a cross-sectional view taken along line 14—14 of FIG. 13.

The loosely yet positively connected assemblage of components is then placed in a jig 80 shown in FIGS. 12 through 15 of the drawings. The jig 80 consists of a base 82 and side walls 84, 86, 88 and 90. The structure shown in FIG. 4 of the drawings is positioned in the jig with the back panel 54 laying on the base 82, the bottom shell assembly 46 positioned adjacent the side wall 88, the top shell assembly 36 positioned adjacent the wall 84 of the jig 80 and the side panels 60 positioned adjacent the walls 86 and 90 of the jig. A vertical mullion support 92 is then positioned within the cabinet behind the adjustable vertical mullion 34, as seen in FIG. 14 of the drawings, and adjusted to provide firm internal support for the mullion 34.

The side wals of the jig are then raised to a position extending at right angles to the bottom wall 82 and fixed in this position. As this is accomplished the loosely connected components of the outer shell are racked so that the front and back, top and bottom and sides of the outer shell are squared with respect to each other and assume their desired final positions.

Figure 15:
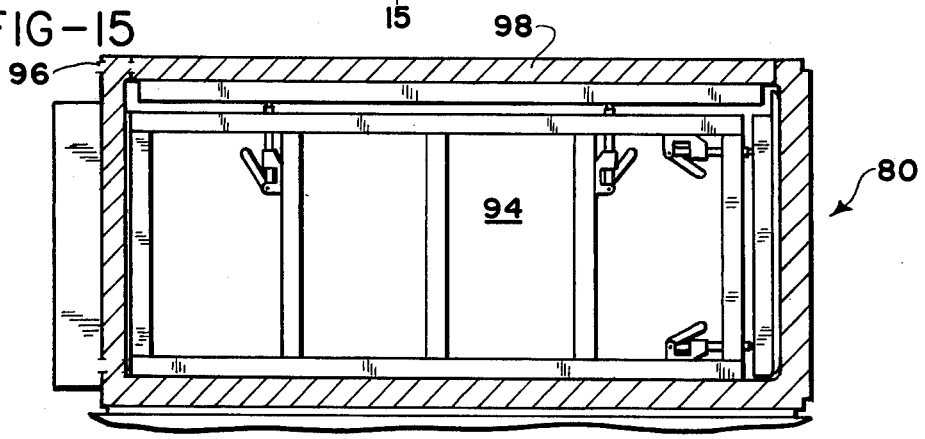
FIG. 15 is a cross-sectional view taken along line 15—15 of FIG. 14.

Of course, internal support as shown at 94 in FIGS. 13 through 15 of the drawings, may be provided having linkage operated expandable portions so that they can be pressed outwardly and provide firm internal support for the inner shell. Such mechanisms can be of any convenient form and do not form per se part of the present invention.

With the enclosure 12 locked within the jig 80 a hardenable insulating material in liquid form, such as polyurethane, is pumped into the insulating cavity 23, through a suitable opening 96 (FIG. 15) provided in the enlosure, with the insulating material foaming in situ and completely filling the insulating cavity as shown at 98 in FIGS. 13 through 15, and when hardened, fixing all of the components of the enclosure in their desired final positional relationship with respect to each other.

Thus the present invention provides an insulated cabinet in which a main structural frame is utilized manufactured to precise tolerances and to which are attached the remaining components of the cabinet outer shell by mechanical connections which permit limited relative movement, and squaring of the enclosure is accomplished just prior to the final step in the manufacturing process through the use of a jig which temporarily fixes the components in their final desired positions until they can be permanently fixed in these positions by means of a hardened insulating material.

While the method and article herein described constitute preferred embodiments of the invention, it is to be understood that the invention is not limited to this precise method and article, and that changes may be made therein without departing from the scope of the invention.

What is claimed is:

1. A method of constructing an insulated cabinet comprising:

rigidly interconnecting in substantially precisely positioned relationship to each other a plurality of structural components to form a substantially rigid main structural frame, loosely attaching additional components to said main frame in non-rigid relationship to each other and said main frame by mechanical connections permitting limited relative movement between said additional components and said main frame, said main frame and loosely interconnected additional components defining an outer shell in which the components thereof are capable of relative limited movement, positioning an inner shell within said outer shell in spaced relationship thereto thereby defining an insulating cavity therebetween, squaring said outer shell to position said main frame and loosely connected additional components in their desired final relationship to each other, while maintaining said main frame and said loosely connected additional components in said desired relationship to each other, substantially filling said insulating cavity with a hardenable insulating material, and allowing said insulating material to harden in said cavity and fix said main frame and additional components in said desired relationship to each other and with said inner shell positioned in spaced relationship to said outer shell.

2. The method of claim 1 wherein:

said step of hardening said insulating material in said cavity includes adhering said insulating material to surfaces of said inner and outer shells defining said cavity.

3. The method of claim 1 wherein said steps of loosely attaching additional components to said main frame and positioning said inner shell within said outer shell comprise:

loosely attaching less than all of said additional components to said main frame to form a partial outer shell, positioning in said parallel outer shell said inner shell, and loosely attaching the remainder of said additional components to said partial outer shell.

4. The method of claim 1 wherein:

said step of positioning said main frame and loosely connected additional components in their desired final relationship to each other includes placing said outer shell in a jig.

5. The method of claim 1 wherein said step of forming a substantially rigid main structural frame includes rigidly interconnecting said structural components in substantially co-planar relationship to each other to form a substantially planar main structural frame.

6. The method of claim 5 wherein:

said step of loosely attaching additional components to said main frame comprises attaching said additional components to said main frame with said additional components projecting outwardly of the plane of said main frame.

7. The method of claim 1 wherein:

said step of loosely attaching said additional components includes deforming contacting portions of said additional components and said main frame to form said mechanical connections.

8. The method of claim 1 wherein:

said step of loosely attaching said additional components includes utilizing threaded fasteners.

* * * * *

UNITED STATES PATENT AND TRADEMARK OFFICE

CERTIFICATE OF CORRECTION

PATENT NO. : 4,040,166

DATED : August 9, 1977

INVENTOR(S) : Paul H. Morphy

It is certified that error appears in the above-identified patent and that said Letters Patent are hereby corrected as shown below:

Column 1, line 16, "cnsuming" should be --- consuming ---.

Column 4, line 20, "groove" should be --- grooves ---.

Column 4, line 37, "wals" should be --- walls ---.

Column 6, line 13, "parallel" should be --- partial ---.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*